US011193371B2

(12) United States Patent
Pfeiffer et al.

(10) Patent No.: US 11,193,371 B2
(45) Date of Patent: Dec. 7, 2021

(54) METHOD OF MINIMIZING IMMISCIBLE FLUID SAMPLE CONTAMINATION

(71) Applicant: Schlumberger Technology Corporation, Sugar Land, TX (US)

(72) Inventors: Thomas Pfeiffer, Katy, TX (US); Vladislav Achourov, Tananger (NO); Ashers Partouche, Katy, TX (US); Pratik Halani, Sugar Land, TX (US); Simon Edmundson, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 17/021,699

(22) Filed: Sep. 15, 2020

(65) Prior Publication Data

US 2021/0095562 A1 Apr. 1, 2021

Related U.S. Application Data

(60) Provisional application No. 62/901,028, filed on Sep. 16, 2019.

(51) Int. Cl.
*E21B 49/08* (2006.01)

(52) U.S. Cl.
CPC ..... *E21B 49/083* (2013.01)

(58) Field of Classification Search
CPC ... E21B 49/0875; E21B 49/088; E21B 33/124
See application file for complete search history.

(56) References Cited

U.S. PATENT DOCUMENTS

| | | | | |
|---|---|---|---|---|
| 5,337,821 | A * | 8/1994 | Peterson | E21B 33/124 166/250.07 |
| 5,804,714 | A * | 9/1998 | Rouhiainen | E21B 47/10 73/152.29 |
| 6,301,959 | B1 * | 10/2001 | Hrametz | E21B 49/10 73/152.23 |
| 6,629,564 | B1 * | 10/2003 | Ramakrishnan | E21B 47/10 166/250.07 |
| 6,964,301 | B2 | 11/2005 | Hill et al. | |
| 7,090,012 | B2 | 8/2006 | Hill et al. | |
| 7,296,462 | B2 * | 11/2007 | Gregory | E21B 33/1243 73/152.51 |
| 8,283,174 | B2 * | 10/2012 | Hal | E21B 49/10 436/28 |
| 9,879,508 | B2 * | 1/2018 | Mebratu | E21B 19/22 |
| 9,952,350 | B1 * | 4/2018 | DiFoggio | G01J 3/457 |
| 2016/0146004 | A1 * | 5/2016 | Wang | E21B 49/10 703/2 |
| 2017/0177761 | A1 * | 6/2017 | Early | E21B 47/00 |
| 2018/0003047 | A1 * | 1/2018 | Sharma | E21B 47/06 |
| 2019/0128117 | A1 * | 5/2019 | Dumont | G01N 33/2823 |
| 2020/0318477 | A1 | 10/2020 | Pfeiffer et al. | |
| 2021/0079754 | A1 | 3/2021 | Yang et al. | |

* cited by examiner

*Primary Examiner* — Shane Bomar
(74) *Attorney, Agent, or Firm* — Trevor G. Grove

(57) ABSTRACT

A method of formation fluid sampling that includes setting a dual packer tool in a wellbore. The dual packer tool is used to isolate an interval between an upper packer and a lower packer. The method also includes drawing fluid from the interval with a lower inlet, until an oil fraction increases over a base line reading, and drawing oil from by pumping at a low rate with an upper inlet.

20 Claims, 3 Drawing Sheets

METHOD OF MINIMIZING IMMISCIBLE FLUID SAMPLE CONTAMINATION

CROSS-REFERENCE TO RELATED APPLICATIONS

This application claims priority to and benefit of U.S. Patent Application Ser. No. 62/901,028 filed Sep. 16, 2019, which is incorporated by reference herein.

BACKGROUND

This disclosure relates to formation testing that uses a dual packer subsystem.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

One or more methods of formation testing as described and shown. In one or more embodiments, the method can include conveying a dual packer tool into a wellbore. Isolating an interval of the wellbore using and upper and lower packer. Drawing fluid from the isolated interval with a lower inlet until a base line oil fraction is detected, and then opening an upper inlet to draw oil at a low pump rate from the isolated interval.

Various refinements of the features noted above may be undertaken in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which.

DETAILED DESCRIPTION

One or more specific embodiments of the present disclosure will be described below. These described embodiments are examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would still be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

Figure 1:
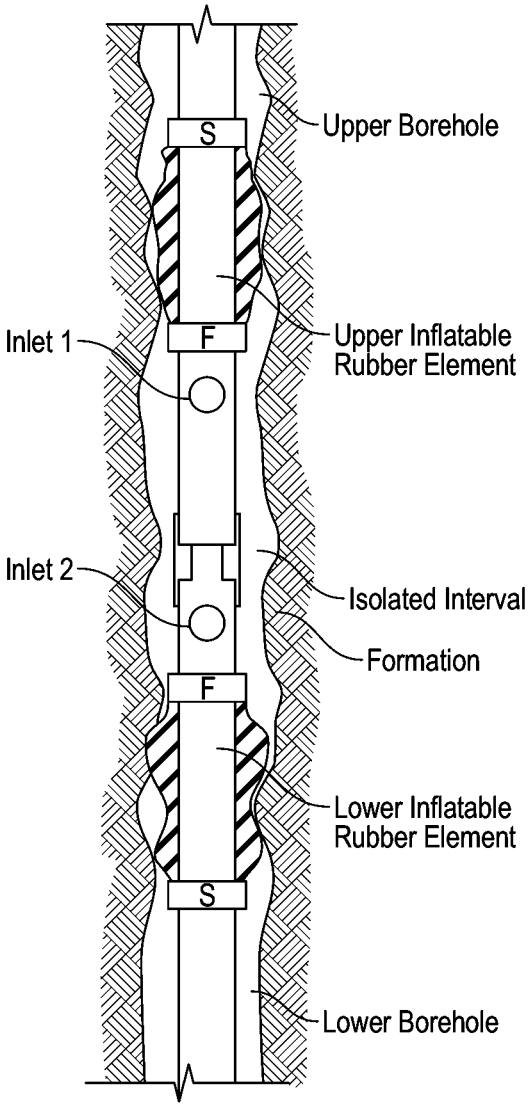
FIG. 1 depicts a dual packer sampling tool in a borehole.

FIG. 1 depicts a dual packer sampling tool in a borehole. The dual packer tool can have an upper inflatable rubber element and a lower inflatable rubber element. The dual packer tool has at least two inlets between the inflatable rubber elements. The inlets are in communication with an isolated interval. During formation testing applications fluid is pumped out from the isolated interval and can enter the tool though either of the two inlets. The interval is initially filled with drilling mud. As the fluid is pumped out of the interval it is replenished by the formation around the interval. The replenishing fluid is initially drilling mud filtrate followed by the reservoir fluid. The density difference between the formation fluid and the drilling mud filtrates will make the fluid phases segregate within the isolated interval. In non-horizontal wells, the level of the interface between the fluid phases can be controlled by pumping from one inlet. The aim is to submerge the other inlet completely in the phase that one desires to sample and thus eliminate any filtrate contamination.

Figure 2:
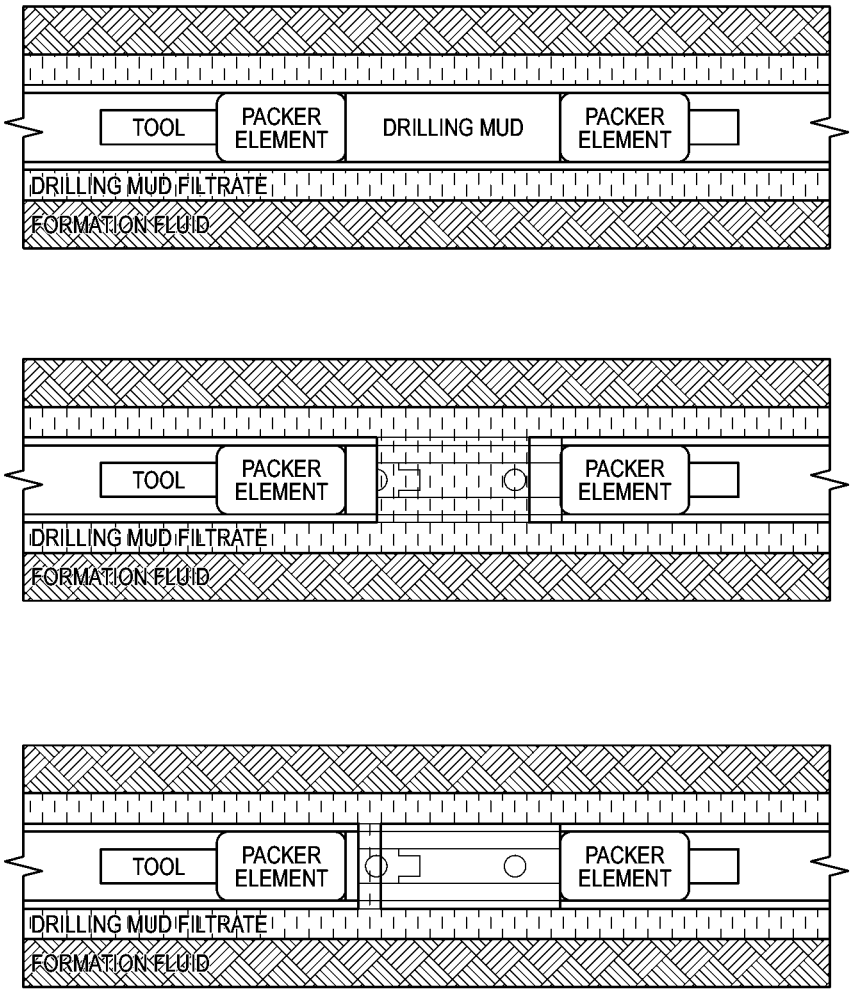
FIG. 2 depicts a schematic of an embodiment of a method of formation fluid sampling.

FIG. 2 depicts a schematic of an embodiment of formation fluid sampling. The method can include pumping drilling mud that is in the isolated interval using the lower inlet. As drilling mud is removed from the isolated interval it is replaced by mud filtrate. The lower inlet is in communication with a first flowline inside the dual packer tool body, and the upper inlet is connected to another flow line. A fluid analyzer identifies the flowing phases in both flow lines. Filtrate break through is observed when the interface between the filtrate and the drilling mud reaches the lower inlet. At this point the pump that is connected to the upper inlet may be turned on at a low rate. Clean-up pumping continues from the lower inlet to continuously lower the filtrate/oil interface below the upper inlet. When the formation oil reaches the lower inlet the top inlet is fully submerged in oil. Sampling is conducted when observe substantially pure oil is coming from the top inlet. Substantially pure oil can be when the contamination level is below a predetermined threshold, for example, the predetermined threshold can be 0.1 percent, 0.2 percent, 0.3 percent, 1 percent, 2 percent, 5 percent, 10 percent, or any other percent of contaminate that is predetermined. One skilled in the art with the aid of this disclosure would know how to determine the threshold and appropriate value thereof.

The method includes pumping from the lower inlet. At the time the oil fraction increases over base line reading at the lower inlet, the Line 1 pump from the upper inlet is turned on and oil is skimmed off at a low rate. For a heavier phase (e.g. water in oil based mud), the same strategy applies, but the role of the upper and lower inlet is reversed.

Figure 3:
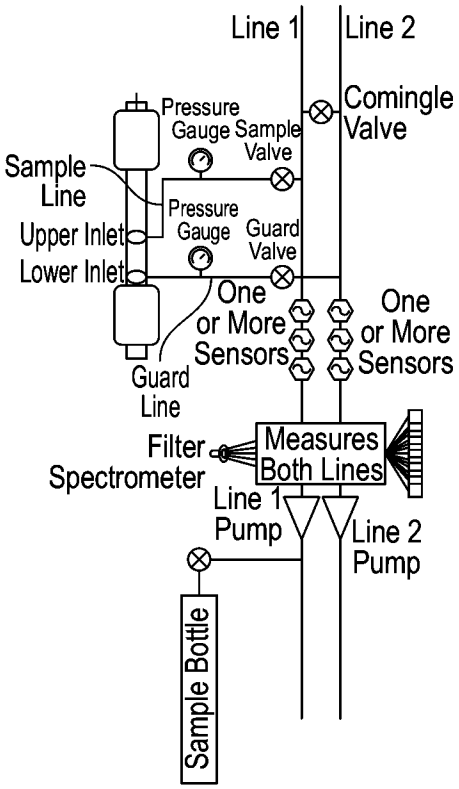
FIG. 3 depicts dual flow line architecture allows for maximum flexibility of placement of the subsystems (pumps, fluid analyzer and sample bottles) with respect to the dual packer.
Figure 3:
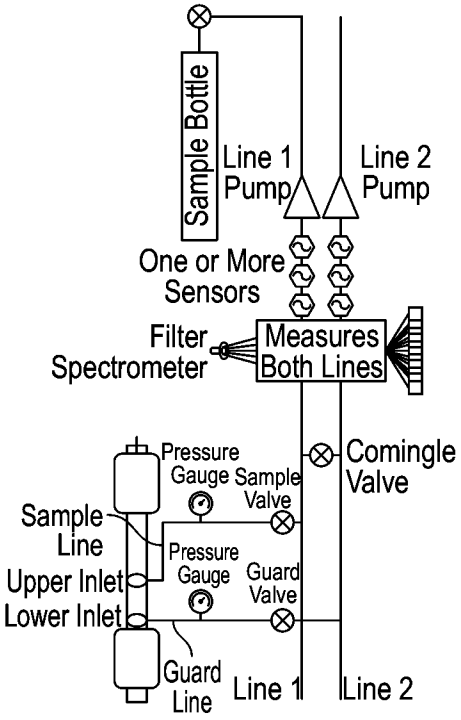

FIG. 3 depicts a dual flow line architecture that allows for maximum flexibility of placement of the subsystems (pumps, fluid analyzer and sample bottles) with respect to the dual packer. The two flow lines run the length of the tool. The fluid analyzer, pumps and sample bottles can be placed above or below the dual packer or a mixture of above and below. The pump rates and direction is controlled individually over a wide range of flow rates and differential pressures. Inter-tool communication and downhole processing is utilized to automate the entire process. Inflation of the packer elements can be done automatically. Inlet valves and pumps may be controlled in accordance to the observations on the fluid analyzer. Fluid phases in the fluid analyzer can be determined using now known or future known techniques. The timing of how to control the pumps and inlet valves are based on the flowing fraction. FIG. 3 depicts the fluid fractions of both flow lines: the top plot shows the flowing fractions coming from the upper inlet and the lower plot shows the fluid fractions coming from the lower inlet.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

The invention claimed is:

1. A method of formation fluid sampling, comprising:

a. setting a dual packer tool in a wellbore;

b. isolating an interval between an upper packer and a lower packer;

c. drawing fluid from the interval with a lower inlet into a first flowline located inside the dual packer tool until an oil fraction increases over a base line reading; and d. drawing oil from the interval with an upper inlet into a second flowline located inside the dual packer tool once the oil fraction drawn into the lower inlet increases over the base line reading.

2. The method of claim 1, wherein the fluid drawn from the interval with the lower inlet initially comprises a drilling mud.

3. The method of claim 2, wherein, after drawing the fluid from the interval for a first period of time, the fluid drawn from the interval with the lower inlet comprises a filtrate/oil mixture.

4. The method of claim 3, wherein after drawing the fluid from the interval for a second period of time following the first period of time, the fluid drawn from the interval with the lower inlet comprises the oil.

5. The method of claim 4, wherein a sample of the oil drawn from the interval with the upper inlet is introduced into a sample bottle located inside the dual packer tool when the fluid drawn from the interval with the lower inlet comprises the oil.

6. The method of claim 5, wherein a composition of the fluid drawn from the interval with the lower inlet and a composition of the oil drawn from the interval with the upper inlet are determined with a common spectrometer.

7. The method of claim 1, wherein a phase of the fluid drawn from the interval with the lower inlet and a phase of the oil drawn from the interval with the upper inlet are determined with a common analyzer.

8. The method of claim 1, wherein a guard line fluidly connects the lower inlet with the first flowline and a sample line fluidly connects the upper inlet with the second flowline, and wherein a first pressure gauge is in fluid communication with the guard line and a second pressure gauge is in fluid communication with the sample line.

9. The method of claim 1, wherein the first flowline and the second flow line each run a length of the dual packer tool.

10. A method of formation fluid sampling, comprising:

a. setting a dual packer tool in a wellbore;

b. isolating an interval between an upper packer and a lower packer;

c. drawing a drilling mud from the interval with a lower inlet into a first flowline located inside the dual packer tool until a filtrate/drilling mud mixture is obtained;

d. drawing fluid from the interval with an upper inlet into a second flowline located inside the dual packer tool once the filtrate/drilling mud mixture is obtained with the lower inlet;

e. continuing the drawing of the filtrate/drilling mud mixture from the interval with the lower inlet until a formation oil is obtained to fully submerge the upper inlet in the formation oil; and f. introducing a sample of the fluid drawn into the second flowline with the upper inlet into a sample bottle located inside the dual packer tool after the formation oil is obtained with the lower inlet, wherein the fluid introduced into the sample bottle comprises formation oil having a contamination level that is below a predetermined threshold.

11. The method of claim 10, wherein the predetermined threshold is a contamination level of less than 10% of contaminants in the oil.

12. The method of claim 10, wherein the predetermined threshold is a contamination level of less than 1% of contaminants in the oil.

13. The method of claim 10, wherein a composition within the first flow line and a composition within the second flowline are determined with a common spectrometer.

14. The method of claim 10, wherein the first flowline and the second flow line each run a length of the dual packer tool.

15. The method of claim 10, wherein a first pump is used to draw the drilling mud, the filtrate/drilling mud mixture, and the formation oil from the interval with the lower inlet, and wherein a second pump is used to draw the fluid from the interval with the upper inlet.

16. The method of claim 10, wherein:

a composition within the first flowline and a composition within the second flowline are determined with a common spectrometer, a first pump is used to draw the drilling mud, the filtrate/drilling mud mixture, and the formation oil from the interval with the lower inlet, a second pump is used to draw the fluid from the interval with the upper inlet, and the first and second pumps, the sample bottle, and the spectrometer are each located above the upper packer.

17. The method of claim 10, wherein:

a composition within the first flowline and a composition within the second flowline are determined with a common spectrometer, a first pump is used to draw the drilling mud, the filtrate/drilling mud mixture, and the formation oil from the interval with the lower inlet, a second pump is used to draw the fluid from the interval with the upper inlet, and the first and second pumps, the sample bottle, and the spectrometer are each located below the lower packer.

18. The method of claim 10, wherein a comingle valve is in fluid communication with the first flow line and the second flowline.

19. The method of claim 10, wherein a guard line fluidly connects the lower inlet with the first flowline and a sample line fluidly connects the upper inlet with the second flowline, and wherein a first pressure gauge is in fluid communication with the guard line and a second pressure gauge is in fluid communication with the sample line.

20. The method of claim 10, wherein:

a composition within the first flowline and a composition within the second flowline are determined with a common spectrometer, the first flowline and the second flow line each run a length of the dual packer tool, a comingle valve is in fluid communication with the first flow line and the second flowline, and a guard line fluidly connects the lower inlet with the first flowline and a sample line fluidly connects the upper inlet with the second flowline, and wherein a first pressure gauge is in fluid communication with the guard line and a second pressure gauge is in fluid communication with the sample line.

* * * * *